United States Patent [19]

D'Amicis

[11] 4,138,104

[45] Feb. 6, 1979

[54] SWING BRAKE SYSTEM

[76] Inventor: William C. D'Amicis, 87 E. Brown St., West Haven, Conn. 06516

[21] Appl. No.: 805,091

[22] Filed: Jun. 9, 1977

[51] Int. Cl.[2] ..... A63G 9/00

[52] U.S. Cl. ..... 272/85; 248/370; 248/317

[58] Field of Search ..... 272/85, 86, 87, 88, 272/61, 89, 90, 91, 92; 248/370, 378, 17, 26, 214, 317, 340; 297/273, 274, 275, 276, 277, 278, 279, 280, 281, 282; 135/74, 15

[56] References Cited

U.S. PATENT DOCUMENTS

| | | | |
|---|---|---|---|
| 3,149,638 | 9/1964 | Small | 135/74 |
| 3,164,160 | 12/1965 | Small | 135/74 |
| 3,182,673 | 5/1965 | Small | 135/74 |

FOREIGN PATENT DOCUMENTS

| | | | |
|---|---|---|---|
| 405611 | 12/1967 | Australia | 272/85 |
| 1301413 | 7/1961 | France | 135/15 |

*Primary Examiner*—Richard C. Pinkham
*Assistant Examiner*—T. Brown
*Attorney, Agent, or Firm*—DeLio and Montgomery

[57] ABSTRACT

A playground swing mounting system wherein the side supports are at least partially in the form of rigid rods or tubes having their upper ends connected to the crossbar or other stationary mounting element by means of springs. Each spring is enclosed within a short tube rigidly fixed on the stationary element and so proportioned that, at rest, the upper ends of the side supports are drawn by the springs far enough into the short tubes to prevent free movement of the swing seat, thus constituting a brake; the weight of a passenger on the seat extends the springs and pulls the side supports down to a free swinging position.

7 Claims, 3 Drawing Figures

SWING BRAKE SYSTEM

This invention relates to a playground swing mounting system wherein the side supports are at least partially in the form of rigid rods or tubes having their upper ends connected to the crossbar or other stationary mounting element by means of springs. Each spring is enclosed within a short tube rigidly fixed on the stationary element and so proportioned that, at rest, the upper ends of the side supports are drawn by the springs far enough into the short tubes to prevent free movement of the swing seat, thus constituting a brake; the weight of a passenger on the seat extends the springs and pulls the side supports down to a free swinging position.

Playground swings are simple and traditional items of entertainment and enjoyment, and are commonly made of various materials, from the rope swing with wooden seat hung from a tree limb to elaborate metal structures with wood or metal seats supported by chains and/or rods or tubes from a metal crossbar. In all their forms, and despite their simplicity, they pose a danger in that the seat moves with great velocity, whether occupied or not, and can seriously hurt a child who may wander within range. It is not uncommon for an empty swing to be started on its course, just for the fun of it and regardless of possible danger to others, whereas a swing with an occupant is more noticeable and easily avoided.

It is accordingly an object of the present invention to provide a swing mounting system wherein the movement of the side supports is strictly limited, when the swing is empty, but wherein the restraint is completely removed as soon as the seat is occupied.

It is a further object of the invention to provide an effective swing brake which is made from readily available mechanical elements.

It is another object of the invention to provide a swing mounting system wherein a predetermined minimum weight is required to make the swing usable, while a stop prevents over-stretching in response to excessive weights.

It is a still further object of the invention to provide certain improvements in the form, construction and arrangement of the several parts whereby the above-named and other objects may effectively be attained.

The invention accordingly comprises the features of construction, combinations of elements, and arrangement of parts which will be exemplified in the construction hereinafter set forth, and the scope of the invention will be indicated in the claims.

A practical embodiment of the invention is shown in the accompanying drawing, wherein.

Figure 1:
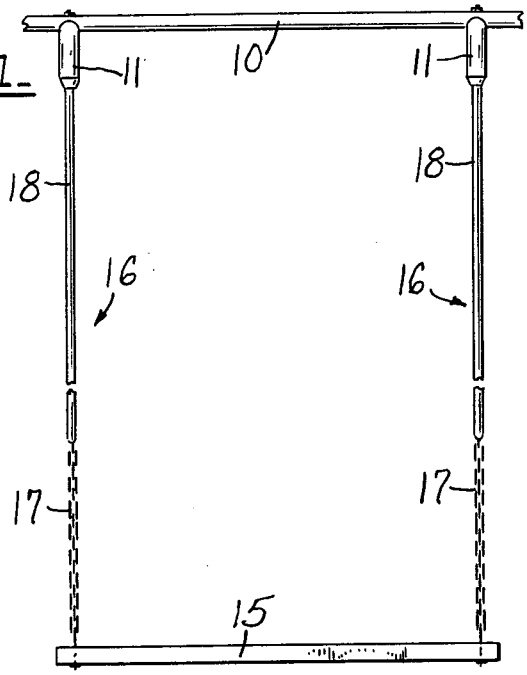
FIG. 1 represents an elevation of the swing, portions of the supporting structure being omitted.

Referring to the drawing, a conventional horizontal crossbar support for the swing is shown at 10, comprising a strong steel pipe supported at its ends in any customary manner as by tripods or posts, not shown. The support is modified by the addition of the brake tube 11, shown as being fitted around an opening in the lower side of the crossbar and welded thereto, as indicated at 12. The upper wall of the crossbar is bored to receive the shank of an eye bolt 13 with nut 14, by means of which the position of the spring can be adjusted.

Figure 2:
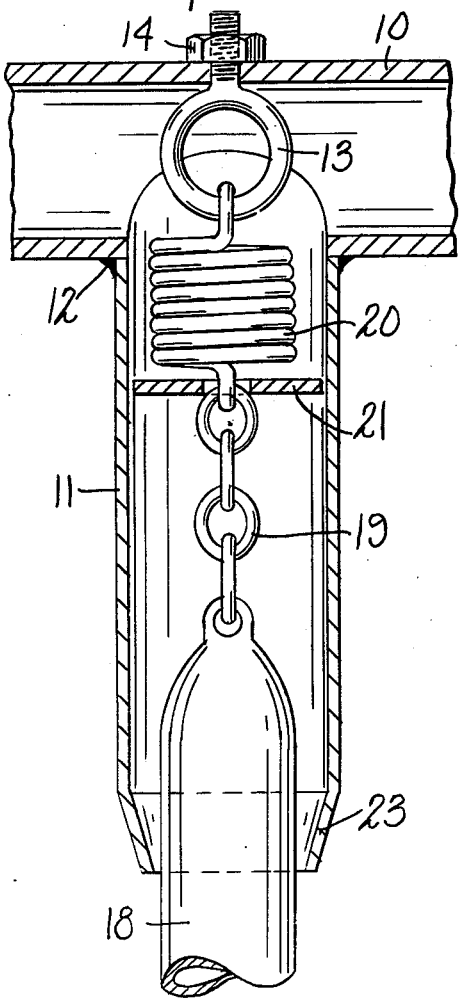
FIG. 2 represents a detail vertical section through the spring brake, portions being broken away.

The swing comprises a seat 15, of conventional form and material, with side supports 16 each having a lower chain portion 17 and an upper rigid portion 18, which may be a rod or a tube, usually the latter. The upper end of each portion 18 is connected by a short flexible chain 19 to a strong coil spring 20 the upper end of which is fixed on the eye bolt 13. At rest, the spring 20, chain 19 and top few inches of the portion 18 are located within the brake tube 11, as shown in FIG. 2. The lower end of the spring, adjacent its point of attachment to the chain, is provided with a stop disc 21 which has a diameter slightly smaller than the inner diameter of the brake tube but greater than the diameter of the bottom opening 22 of the tube where it is tapered slightly inward as shown at 23.

Figure 3:
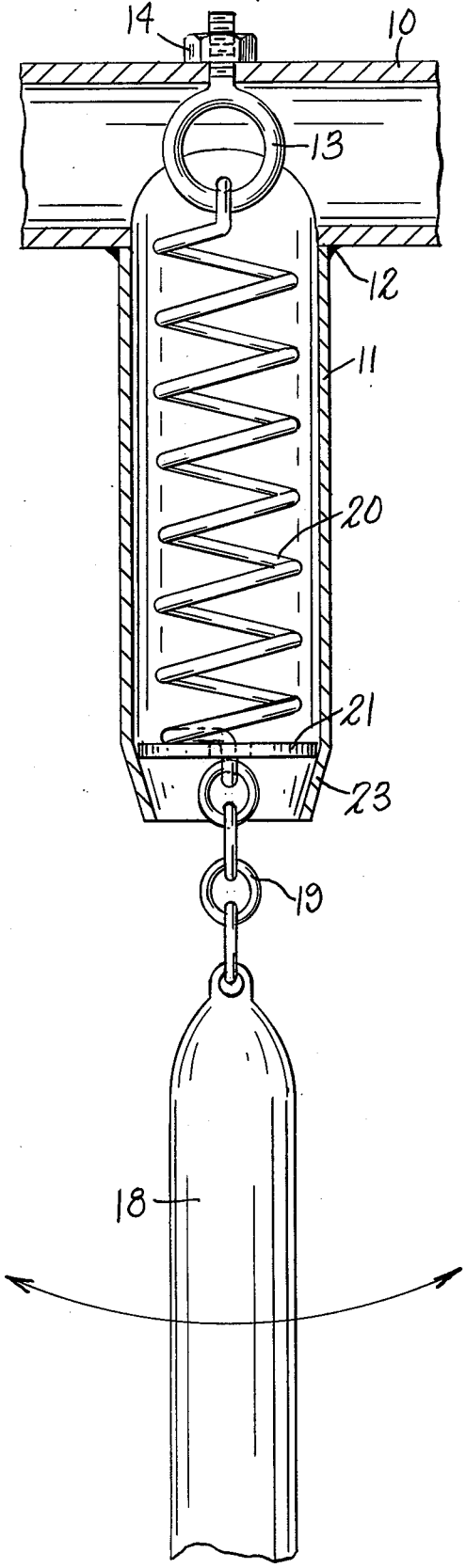
FIG. 3 represents a similar detail vertical section showing the positions of the parts when the swing has a passenger.

The parts are so proportioned that the contracted spring occupies only a small portion of the brake tube while at least several inches of the side support portion 18 project into the tube, when the swing is not loaded. In this position (FIG. 2) the movement of the swing is sharply curtailed by the engagement of the portions 18 in their respective brake tubes and it is impossible to cause free swinging movement of more than a few degrees, which would present little danger of injury. The spring strength is such as to permit extension in response to the weight of a small child sitting in the seat; forty or fifty pounds will normally extend the spring sufficiently to free the tops of the portions 18, and greater weights will cause extension to the position shown in FIG. 3 where the stop disc 21 rests against the narrowed wall 23. In this position further extension of the spring is arrested, so that the spring can never be stretched beyond its elastic limit. Radially inwardly bent fingers could also be used.

Swings wherein the side supports include springs are known, as exemplified by the patents to Williams, No. 683,539, and Grudoski, No. 3,271,029, but there has been no provision for a braking effect and no disclosure of a fixed tube on the frame in combination with a spring support.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

What I claim is:

1. A swing comprising a stationary mounting element, a seat, side supports for the seat, each side support including a straight rigid element at least at the upper end of the side support and a spring, the rigid element being connected to the spring by a short flexible element, a pair of brake tubes fixed in vertical positions on the stationary mounting element and spaced to cooperate with the side supports, and means securing the upper end of each spring to the mounting element, said spring being within one of said brake tubes and at a height such that the short flexible element and a portion of the rigid element are within the tube when the seat is unoccupied and the rigid element can be drawn out of the tube when the seat is occupied.

2. A swing according to claim 1 which includes means preventing the spring from being drawn out of the tube.

3. A swing according to claim 2 wherein said preventing means includes a stop member associated with the lower end of the spring and the tube includes a portion adapted to engage the stop member.

4. A swing according to claim 3 wherein the stop member is a disc and the lower portion of the tube is inwardly tapered to prevent passage of the disc.

5. A brake for a swing having a rigid side support comprising a short brake tube, a spring, a short flexible element connected to one end of the spring, means for rigidly mounting the brake tube vertically on a fixed mounting element, means for connecting the flexible element to the rigid side support and means for securing the other end of the spring to the mounting element so that the spring will be within the brake tube such that the spring, the flexible element and part of the side support are within the brake tube when the swing is at rest.

6. A brake for a swing according to claim 5 which includes a stop member associated with the lower end of the spring and the brake tube includes a portion adapted to engage the stop member.

7. A brake for a swing according to claim 6 wherein the stop member is a disc.

* * * * *